US009341385B2

(12) United States Patent
Ahn

(10) Patent No.: US 9,341,385 B2
(45) Date of Patent: May 17, 2016

(54) EVAPORATIVE HUMIDIFIER

(71) Applicant: SAMSUNG ELECTRONICS CO., LTD., Suwon-si, Gyeonggi-do (KR)

(72) Inventor: Jong Chul Ahn, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 519 days.

(21) Appl. No.: 13/729,670

(22) Filed: Dec. 28, 2012

(65) Prior Publication Data

US 2013/0113123 A1 May 9, 2013

(30) Foreign Application Priority Data

Dec. 18, 2012 (KR) ..... 10-2012-0148265

(51) Int. Cl.
*F24F 6/02* (2006.01)
*F24F 6/06* (2006.01)

(52) U.S. Cl.
CPC .... *F24F 6/02* (2013.01); *F24F 6/06* (2013.01)

(58) Field of Classification Search
CPC ..... F24F 6/06; F24F 2006/065; B01D 47/18
USPC ..... 261/92
See application file for complete search history.

(56) References Cited

U.S. PATENT DOCUMENTS 1,181,886 A * 5/1916 High ..... F24F 6/06 261/30
1,704,663 A * 3/1929 Noden ..... B01D 47/16 261/92
1,961,508 A * 6/1934 Persons ..... F24F 6/06 261/92
2,253,418 A * 8/1941 Crandall ..... F24F 6/06 261/24
2,258,357 A * 10/1941 Goodman ..... F24F 6/06 239/220
2,343,820 A * 3/1944 Thornton ..... F24F 6/06 239/220

(Continued)

FOREIGN PATENT DOCUMENTS

CN 2653361 Y * 11/2004
CN 102679519 A * 9/2012

(Continued)

OTHER PUBLICATIONS

FLS, Inc translation of Fukushima et al. JPS 55-69643 published May 13, 1980.*

(Continued)

*Primary Examiner* — Duane Smith
*Assistant Examiner* — Stephen Hobson
(74) *Attorney, Agent, or Firm* — Staas & Halsey LLP

(57) ABSTRACT

An evaporative humidifier includes a humidifying element having water pockets drawing water up from a tub and then supplying the water to the upper portion of the humidifying element. The water pockets are formed between first and second covers. A first water pocket formation unit is provided on the first cover, a second water pocket formation unit is provided on the second cover, and the first and second water pocket formation units form the water pockets when the first and second covers are coupled. Therefore, the water pockets are formed through molds having a simple structure, as compared to the conventional water pocket, and thus manufacturing costs of the humidifying element assembly are reduced. Further, each water pocket includes plural sub water pockets formed at both sides of an inflow hole formed at the center of each water pocket, and thus carries a large amount of water.

21 Claims, 10 Drawing Sheets

(56) References Cited

U.S. PATENT DOCUMENTS

| | | | | | |
|---|---|---|---|---|---|
| 3,266,784 | A * | 8/1966 | Saito | B01D 53/26 | 261/138 |
| 3,283,478 | A * | 11/1966 | Briggin | B01F 3/04035 | 261/29 |
| 3,479,801 | A * | 11/1969 | Yamasaki | A61M 16/16 | 261/92 |
| 3,544,084 | A * | 12/1970 | Macrow | B01D 47/16 | 261/29 |
| 3,599,942 | A * | 8/1971 | Herr | F24F 6/06 | 126/113 |
| 3,733,062 | A * | 5/1973 | Bracich | F24F 6/06 | 261/92 |
| 3,886,074 | A * | 5/1975 | Prosser | C02F 3/082 | 210/150 |
| 4,145,384 | A * | 3/1979 | Wagaman | F24F 6/04 | 261/106 |
| 4,762,539 | A * | 8/1988 | Muto | B01D 47/18 | 261/92 |
| 5,320,524 | A * | 6/1994 | de Beus | B01D 45/10 | 432/103 |
| 6,832,753 | B1 * | 12/2004 | Huang | F24F 6/06 | 261/28 |
| 2009/0081407 | A1 * | 3/2009 | Giraud | 428/98 | |
| 2010/0258644 | A1 * | 10/2010 | Kagawa | C02F 1/281 | 236/44 A |
| 2011/0049732 | A1 * | 3/2011 | Kim | F24F 6/06 | 261/92 |
| 2011/0084414 | A1 * | 4/2011 | Ahn | F24F 3/14 | 261/91 |
| 2011/0084415 | A1 * | 4/2011 | Kim | F24F 6/06 | 261/92 |
| 2012/0161343 | A1 * | 6/2012 | Ha | F24F 6/06 | 261/92 |
| 2012/0297975 | A1 * | 11/2012 | Joung | F24F 6/06 | 95/1 |
| 2013/0113123 | A1 * | 5/2013 | Ahn | F24F 6/06 | 261/31 |

FOREIGN PATENT DOCUMENTS

| | | | | |
|---|---|---|---|---|
| CN | 203116237 U | * | 8/2013 | |
| DE | 530553 C | * | 7/1931 | B01D 47/02 |
| GB | 283028 | * | 4/1927 | |
| JP | S 55-69643 | * | 5/1980 | |
| JP | 2010043820 | * | 2/2010 | |
| JP | 2011033303 A | * | 2/2011 | |

OTHER PUBLICATIONS

EPO and Google translation of Mitsuhisa et al. JP 2010 043820 A published Feb. 25, 2010.*

EPO and Google translation of Tetsuyoshi et al. JP 2011-33303 published Feb. 17, 2011.*

* cited by examiner

EVAPORATIVE HUMIDIFIER

CROSS-REFERENCE TO RELATED APPLICATIONS

This application claims the priority benefit of Korean Patent Application No. 10-2012-0148265, filed on Dec. 18, 2012 in the Korean Intellectual Property Office, the disclosure of which is incorporated herein by reference.

BACKGROUND

1. Field

Embodiments disclosed herein relate to an evaporative humidifier which executes humidification by naturally evaporating water without the use of ultrasonic waves and a heater.

2. Description of the Related Art

An evaporative humidifier is an electric home appliance which includes a humidifying element absorbing water and an air blower fan forcibly blowing indoor air, and causes indoor dry air to become humid via the humidifying element absorbing water and then to be discharged to an indoor space so as to execute humidification.

In general, the humidifying element is rotatably provided within a main body of the evaporative humidifier, and is rotated to receive water stored in a tub. There are two conventional methods of supplying water to the humidifying element. In the first method, the humidifying element is provided such that the lower portion of the humidifying element is submerged in water in a tub, and thus directly absorbs water in the tub. In the second method, the humidifying element is provided so as not to be submerged in water in a tub, and a water pocket provided at the circumference of the humidifying element draws water up from the tub and supplies the water to the upper portion of the humidifying element.

In case of the former method, most of the water absorbed by the lower portion of the humidifying element flows down before rising to the upper portion of the humidifying element, and thus humidification efficiency is not high. Further, since the lower portion of the humidifying element is submerged in water even if a humidifying function is stopped, mold or bacteria are easily propagated.

On the other hand, the latter method has high humidification efficiency and is cleaner, relative to the former method. However, the water pocket generally has a bowl shape, one surface of which is opened, and thus molding costs associated with manufacture of the humidifying element and the water pocket provided at the circumference of the humidifying element are increased. Further, such a bowl-shaped water pocket may draw water up from the tub only when the water pocket is rotated in a direction in which the opened surface of the water pocket is raised, and does not draw water up from the tub when the water pocket is rotated in the opposite direction.

SUMMARY

Therefore, it is an aspect of the present invention to provide an evaporative humidifier operated in a method in which water pockets provided at the circumference of a humidifying element draw water up from a tub and supply the water to the upper portion of the humidifying element, and which reduces molding costs associated with forming the water pockets, It is another aspect of the present invention to allow the water pockets to draw water up from the tub regardless of the rotating direction of the humidifying element, thereby increasing the water carrying capacity of the water pockets.

Additional aspects of the invention will be set forth in part in the description which follows and, in part, will be apparent from the description, or may be learned by practice of the invention.

In accordance with one aspect of the present invention, an evaporative humidifier includes a main body, an air blower fan provided within the main body so as to forcibly blow air, a tub provided within the main body and storing water, and a humidifying element assembly rotatably provided within the main body, wherein the humidifying element assembly includes a humidifying element executing humidification by absorbing water in the tub and then evaporating water, a first cover provided in front of the humidifying element, and including a first support unit provided at the center of the first cover so as to support the humidifying element, a first horizontal wall unit provided at the edge of the first cover, and a first vertical wall unit protruding perpendicularly from the first horizontal wall unit in the backward direction, a second cover provided in the rear of the humidifying element, coupled with the rear surface of the first cover, and including a second support unit provided at the center of the second cover so as to support the humidifying element, a second horizontal wall unit provided at the edge of the second cover, and a second vertical wall unit protruding perpendicularly from the second horizontal wall unit in the backward direction, and at least one water pocket supplying water to the upper portion of the humidifying element by drawing water up from the tub and then dropping the water, and formed by the first horizontal wall unit, the first vertical wall unit, the second horizontal wall unit and the second vertical wall unit.

Six water pockets may be formed by the first horizontal wall unit, the first vertical wall unit, the second horizontal wall unit and the second vertical wall unit.

The first vertical wall unit and the second vertical wall unit may overlap with each other.

The humidifying element assembly may further include an inflow hole through which water is introduced into the at least one water pocket, and an outflow hole through which water in the at least one water pocket drops to the upper portion of the humidifying element.

The inflow hole and the outflow hole may be formed at the center of the at least one water pocket.

Each of the first vertical wall unit and the second vertical wall unit may include an outer wall part formed in the circumferential direction of the humidifying assembly element, an inner wall part formed in the circumferential direction of the humidifying assembly element and provided at an inner region as compared with the outer wall part so as to be separated from the outer wall part by a designated interval, a first side wall part connecting one end of the outer wall part and one end of the inner wall part, and a second side wall part connecting the other end of the outer wall and the other end of the inner wall part.

Each of the at least one water pocket may include a first sub water pocket formed by a portion of the outer wall part, a portion of the inner wall part and the first side wall part, and a second sub water pocket formed by the remaining portion of the outer wall part, the remaining portion of the inner wall part and the second side wall part.

The at least one water pocket may move upwards under the condition that water is stored in the first sub water pocket when the humidifying element assembly is rotated in one of the clockwise direction and the counterclockwise direction, and the at least one water pocket may move upwards under the condition that water is stored in the second sub water pocket when the humidifying element assembly is rotated in the other of the clockwise direction and the counterclockwise direction.

The first cover may include first coupling parts provided at the edge of the first cover to be coupled with the second cover, and the second cover may include second coupling parts provided at the edge of the second cover so as to correspond to the first coupling parts.

One of the first coupling parts and the second coupling parts may include elastic hooks, and the other of the first coupling parts and the second coupling parts may include support walls supporting the elastic hooks.

The humidifying element may be arranged so as not to be submerged in water in the tub.

The evaporative humidifier may further include a driving motor providing rotary force to rotate the humidifying element assembly, and one of the first cover and the second cover may include a teeth part connected to a gear of the driving motor and receiving the rotary force transmitted from the driving motor.

The evaporative humidifier may further include a gasket provided between the first cover and the second cover so as to maintain airtightness of the at least one water pocket.

The first cover and the second cover may be respectively formed integrally by injection molding.

In accordance with another aspect of the present invention, an evaporative humidifier includes a main body, an air blower fan provided within the main body so as to forcibly blow air, a tub provided within the main body and storing water, and a humidifying element assembly rotatably provided within the main body, wherein the humidifying element assembly includes a humidifying element executing humidification by absorbing water in the tub and then evaporating water, at least one water pocket formed at the circumference of the humidifying element so as to draw water up from the tub and then to supply the water to the upper portion of the humidifying element, a first cover provided in front of the humidifying element so as to support the humidifying element, and including a first water pocket formation unit forming a part of the at least one water pocket, and a second cover provided in the rear of the humidifying element so as to support the humidifying element, coupled with the rear surface of the first cover, and including a second water pocket formation unit forming the remaining part of the at least one water pocket.

The first water pocket formation unit may include a first horizontal wall unit and a first vertical wall unit protruding perpendicularly from the first horizontal wall unit toward the second cover, and the second water pocket formation unit may include a second horizontal wall unit and a second vertical wall unit protruding perpendicularly from the second horizontal wall unit toward the first cover.

Each of the first vertical wall unit and the second vertical wall unit may include an outer wall part formed in the circumferential direction of the humidifying assembly element, an inner wall part formed in the circumferential direction of the humidifying assembly element and provided at an inner region as compared with the outer wall part so as to be separated from the outer wall part by a designated interval, a first side wall part connecting one end of the outer wall part and one end of the inner wall part, and a second side wall part connecting the other end of the outer wall and the other end of the inner wall part, and each of the at least one water pocket may include a first sub water pocket formed by a portion of the outer wall part, a portion of the inner wall part and the first side wall part, and a second sub water pocket formed by the remaining portion of the outer wall part, the remaining portion of the inner wall part and the second side wall part.

In accordance with a further aspect of the present invention, an evaporative humidifier includes a main body, an air blower fan provided within the main body so as to forcibly blow air, a tub provided within the main body and storing water, and a humidifying element assembly rotatably provided within the main body, wherein the humidifying element assembly includes a humidifying element executing humidification by absorbing water in the tub and then evaporating water, and at least one water pocket formed at the circumference of the humidifying element so as to draw water up from the tub and then to supply the water to the upper portion of the humidifying element, wherein each of the at least one water pocket includes an inflow hole provided at the center of each of the at least one water pocket so as to allow water to be introduced into each of the at least one water pocket through the inflow hole, and an outflow hole provided at the center of each of the at least one water pocket so as to allow water in each of the at least one water pocket to drop to the upper portion of the humidifying element through the outflow hole.

Each of the at least one water pocket may include a first sub water pocket and a second sub water pocket formed at both sides of the center of each of the at least one water pocket opposite each other.

In accordance with a further aspect of the present invention, an evaporative humidifier may include a main body, a tub disposed within the main body to store water, and a humidifying element assembly disposed within the main body, which is rotatable in clockwise and counterclockwise directions. The humidifying element assembly may include a disc-shaped humidifying element to perform humidification, a first cover disposed on a first side of the humidifying element, a second cover disposed on a second side of the humidifying element and coupled to the first cover, and a plurality of water pockets formed by the coupling of the first cover and the second cover at an outer circumferential region of the first cover and second cover. The plurality of water pockets may transport water from the tub in an upward direction in either the clockwise or counterclockwise directions when the humidifying element assembly is rotated, drop water on an upper portion of the humidifying element. Each of the plurality of water pocket may include a first sub water pocket to drop water when the humidifying element assembly is rotated in the clockwise direction, and a second sub water pocket to drop water when the humidifying element assembly is rotated in the counterclockwise direction.

The first cover may include a first horizontal wall unit provided at an outer circumferential region of the first cover, and a first vertical wall unit protruding perpendicularly from the first horizontal wall unit in a rearward direction toward the humidifying element. The second cover may include a second horizontal wall unit provided at an outer circumferential region of the second cover, and a second vertical wall unit protruding perpendicularly from the second horizontal wall unit in a forward direction toward the humidifying element. The first vertical wall unit and second vertical wall unit may overlap with one another when the first cover and second cover are coupled together.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
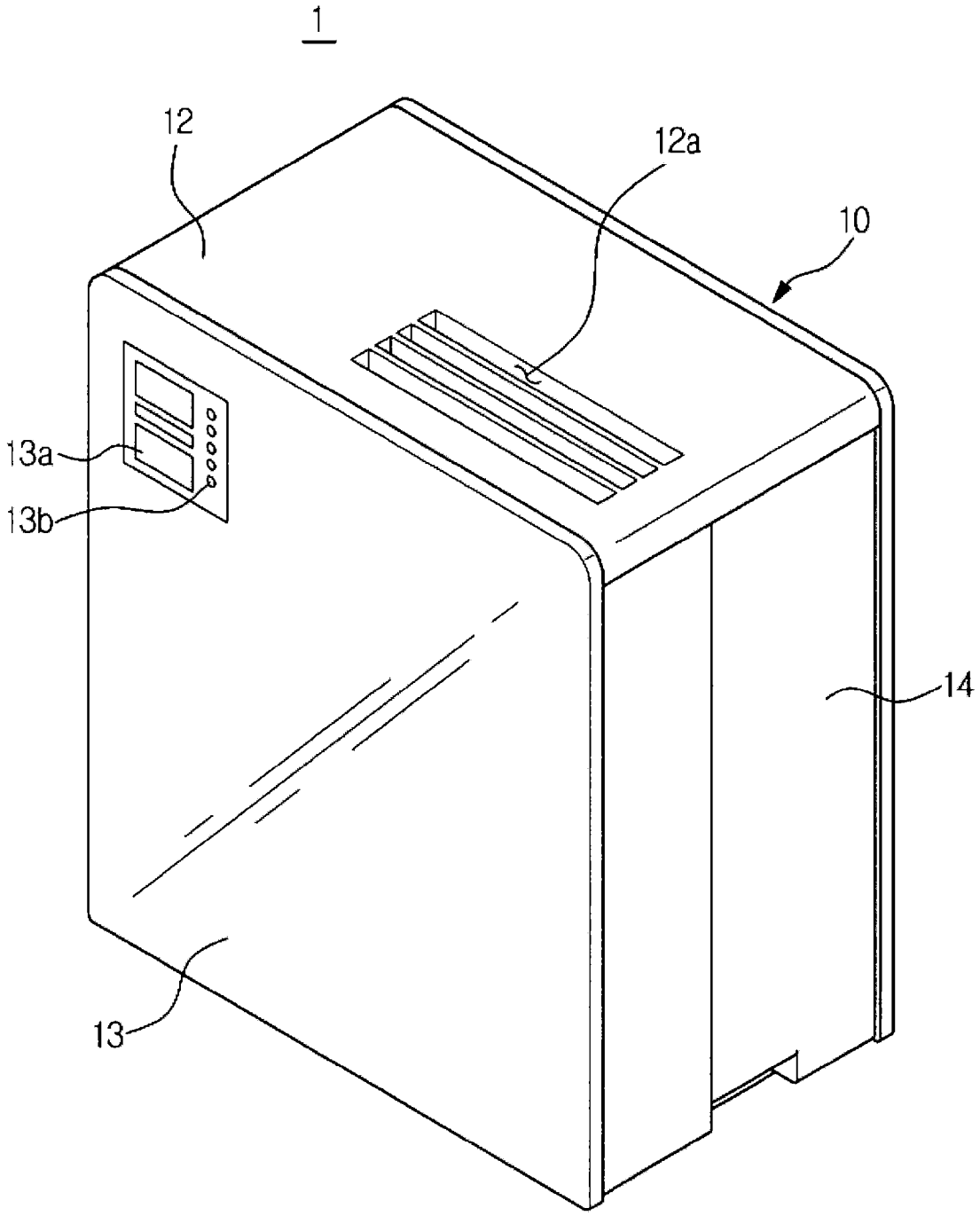
FIG. 1 is a front perspective view of an evaporative humidifier in accordance with one embodiment of the present invention.

Reference will now be made in detail to the embodiments of the present invention, examples of which are illustrated in the accompanying drawings, wherein like reference numerals refer to like elements throughout.

Figure 2:
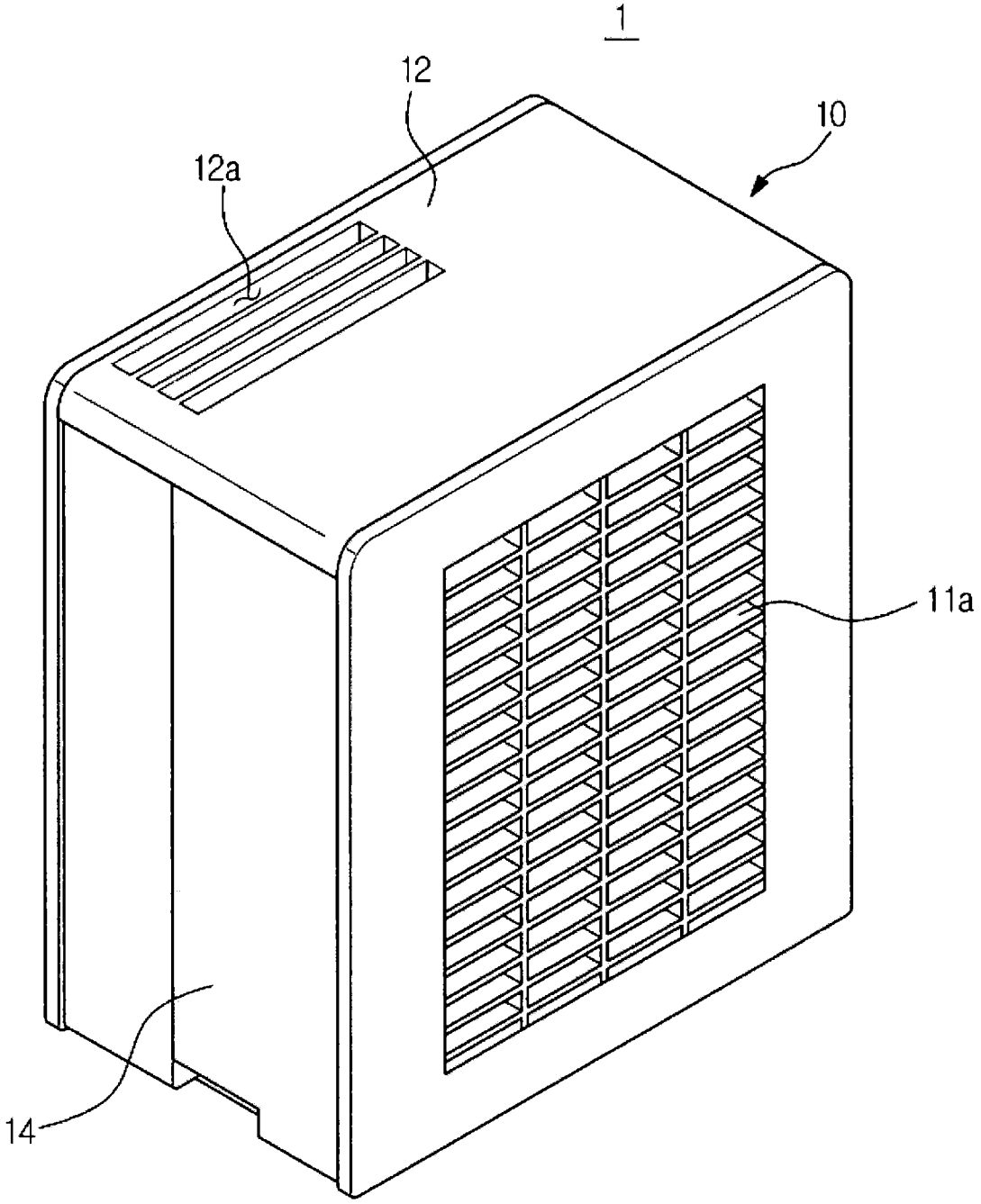
FIG. 2 is a rear perspective view of the evaporative humidifier of FIG. 1.
Figure 3:
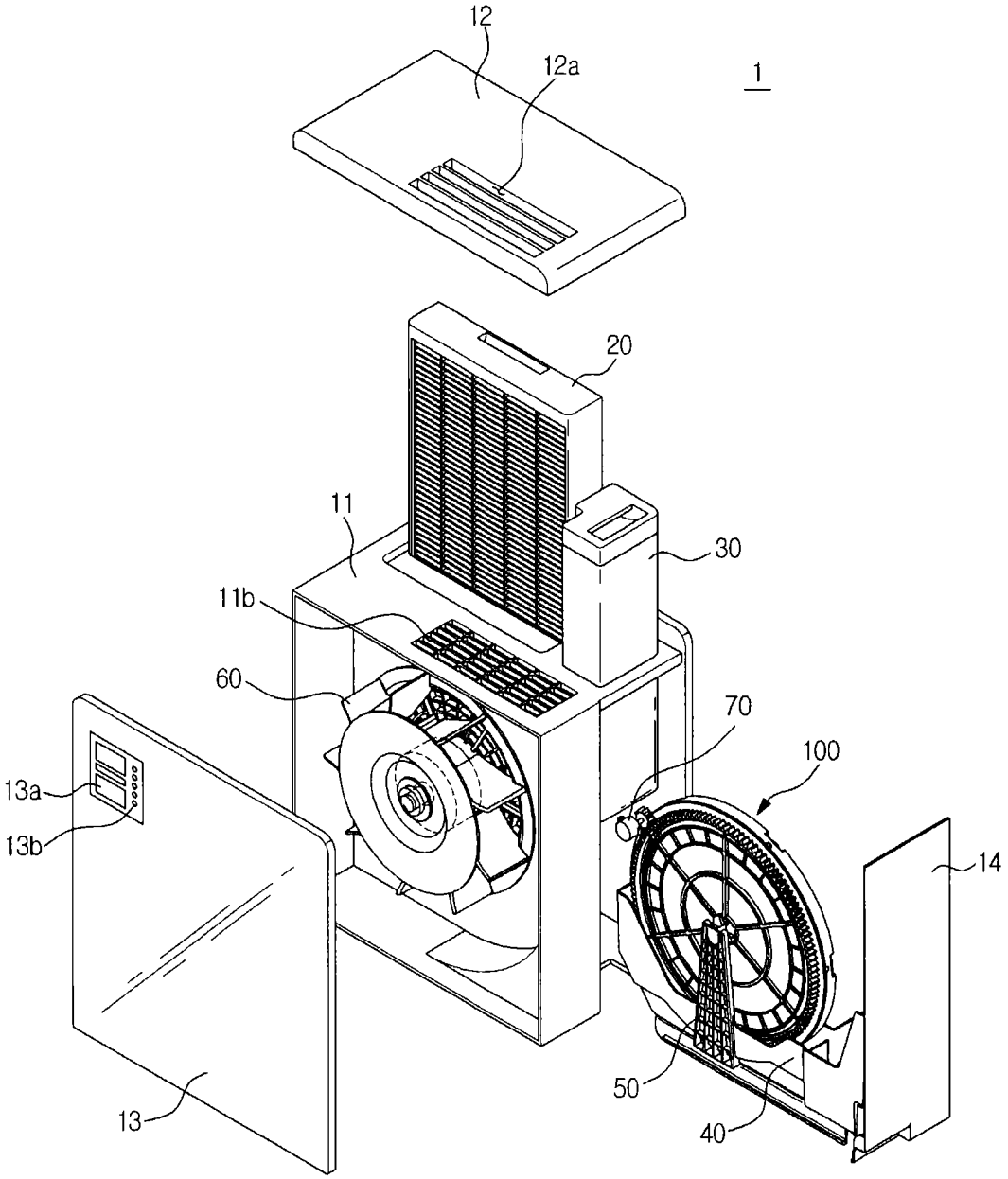
FIG. 3 is a front exploded perspective view of the evaporative humidifier of FIG. 1.

FIG. 1 is a front perspective view of an evaporative humidifier in accordance with one embodiment of the present invention, FIG. 2 is a rear perspective view of the evaporative humidifier of FIG. 1, and FIG. 3 is a front exploded perspective view of the evaporative humidifier of FIG. 1.

With reference to FIGS. 1 to 3, an evaporative humidifier 1 in accordance with the embodiment of the present invention includes a main body 10 forming the external appearance of the evaporative humidifier 1, an air blower fan 60 provided within the main body 10 and forcibly blowing air, a tub 40 provided within the main body 10 and storing water, and a humidifying element assembly 100 rotatably provided within the main body 10 and evaporating water supplied from the tub 40 to execute humidification.

The main body 10 includes a main housing 11, a front cover 13 combined with a front opening of the main housing 11, a side cover 14 combined with a side opening of the main housing 11, and an upper cover 12 combined with the upper surface of the main housing 11.

An inlet 11*a* through which indoor dry air is introduced into the main body 10 may be provided on the rear surface of the main housing 11, and an outlet 11*b* through which humid air acquired by humidification of the inside of the main body 10 is discharged to an indoor space is provided on the upper surface of the main housing 11. A grill part 12*a* corresponding to a location of the outlet 11*b* may be provided on the upper cover 12.

Therefore, indoor dry air is introduced into the main body 10 through the rear surface of the main body 10, is humidified at the inside of the main body 10, and is then discharged to the outside through the upper surface of the main body 10. Such forcible flow of air may be formed by the air blower fan 60. Therefore, the air blower fan 60 may be a centrifugal fan.

A display unit 13*a* to display various pieces of information of the evaporative humidifier 1 and an operation unit 13*b* to operate various functions of the evaporative humidifier 1 may be provided on the front cover 13.

The humidifying element assembly 100 may be rotatably supported by a support frame 50. As shown in FIG. 3, a portion of the frame 50 may extend in an upward vertical direction from a bottom portion of the frame 50 which may be connected to a center portion of the humidifying element assembly 100 to further support the humidifying element assembly 100. The humidifying element assembly 100 may be rotated by rotary force transmitted from a driving motor 70. The humidifying element assembly 100 may be separated from the support frame 50. That is, the humidifying element assembly 100 may be detachable from the support frame 50, such that it can inserted or removed from the support frame 50. The support frame 50 may be combined with the tub 40. That is, the support frame 50 may be integrally formed together with the tub 40. Alternatively, the support frame 50 may be separately formed apart from the tub 40.

Therefore, after the side cover 14 has been separated from the main housing 11, the tub 40 and the humidifying element assembly 100 may be mounted into or separated from the main body 10 in the lateral direction. A detailed configuration of the humidifying element assembly 100 may be described later.

The evaporative humidifier 1 may further include a filter unit 20 to purify air introduced into the main body 10 and a water bucket 30 to supply water to the tub 40. The filter unit 20 may include a dust collection filter, a deodorization filter, etc., and thus the evaporative humidifier 1 in accordance with the embodiment of the present invention may execute an air cleaning function. The filter unit 20 and the water bucket 30 may be mounted into or separated from the main body 10 in the vertical direction after the upper cover 12 is separated from the main housing 11. Therefore, the filter unit 20 and the water bucket 30 may be vertically insertable and removable from an opening formed in the top surface portion of the main body housing 11.

Figure 4:
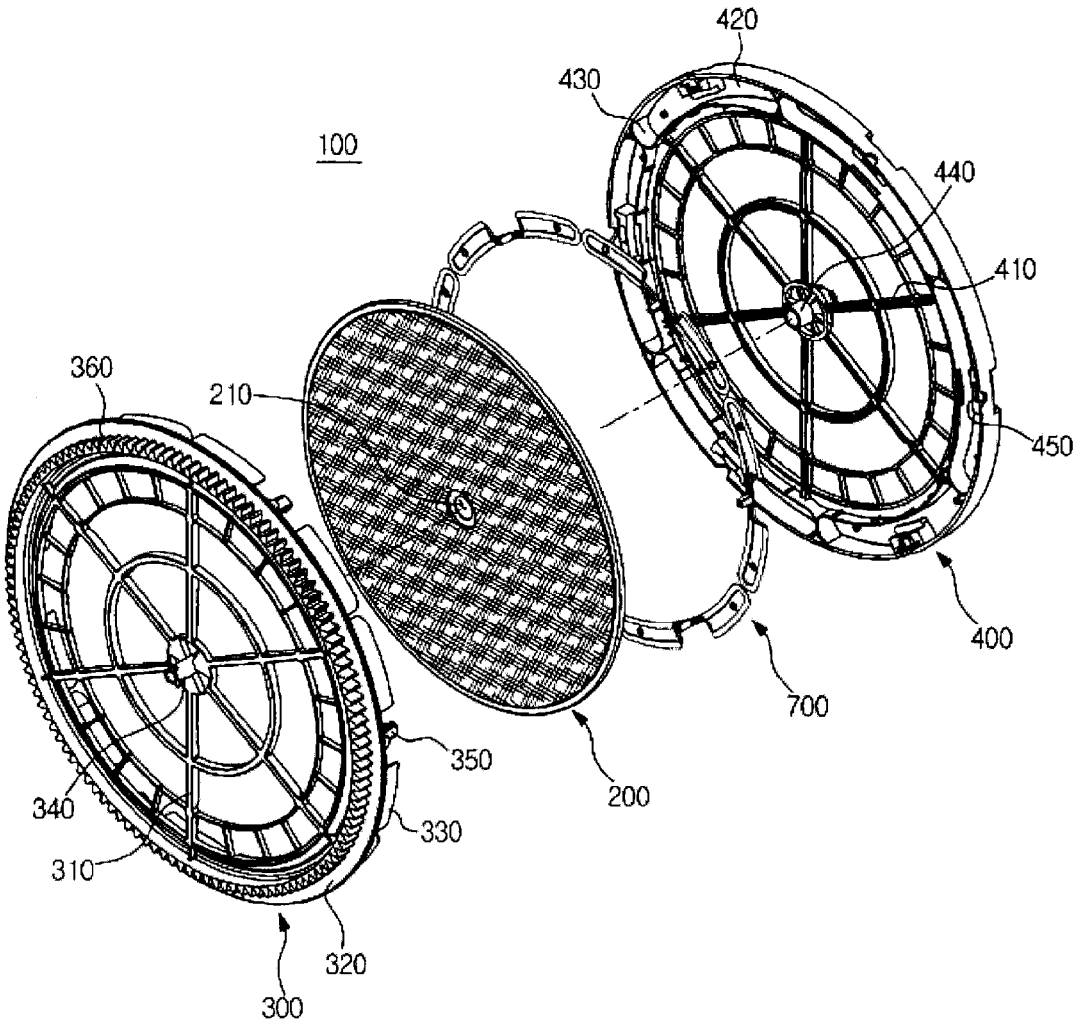
FIG. 4 is a front exploded perspective view of a humidifying element assembly of the evaporative humidifier of FIG. 1.
Figure 5:
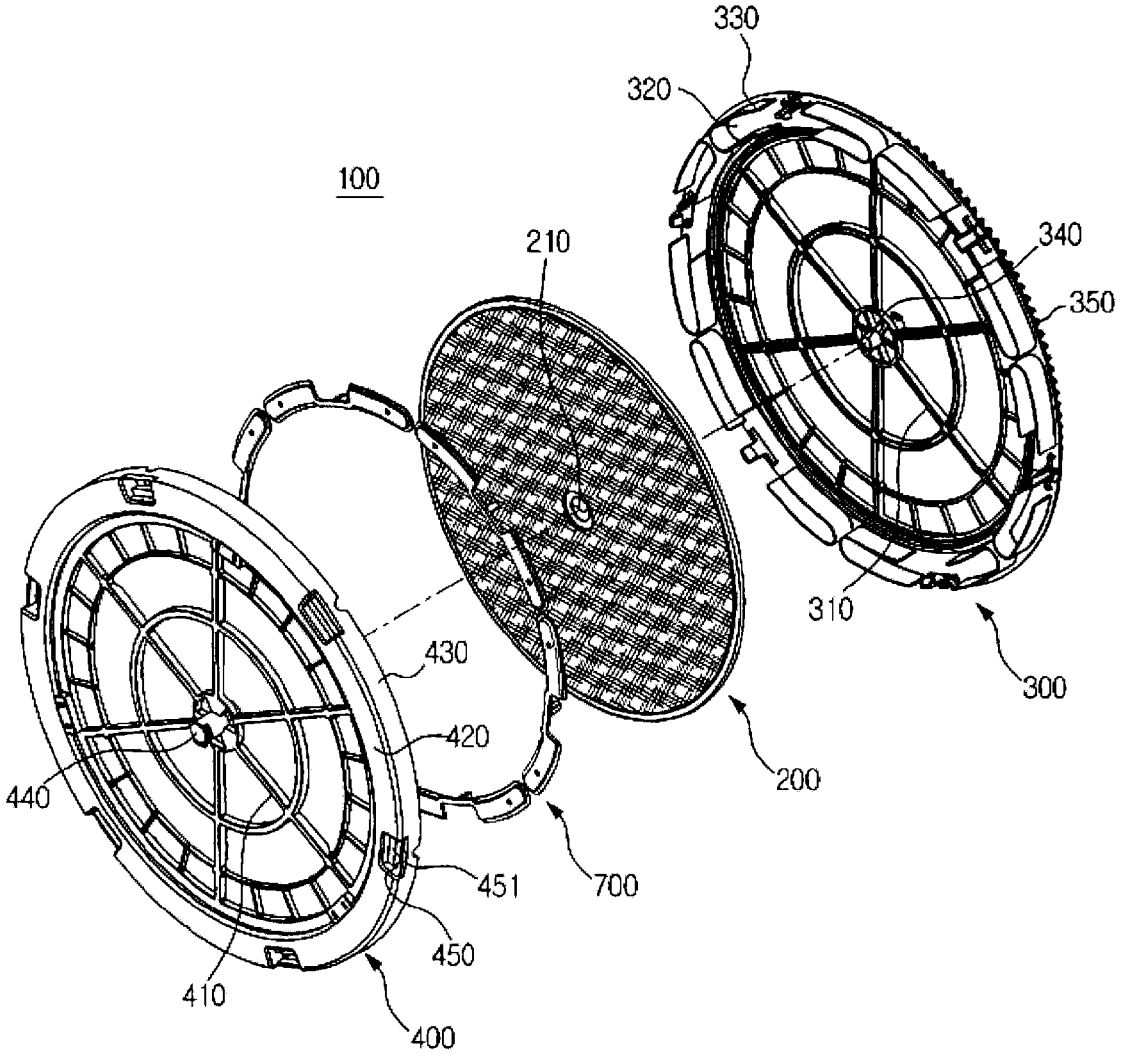
FIG. 5 is a rear exploded perspective view of the humidifying element assembly of the evaporative humidifier of FIG. 1.
Figure 6:
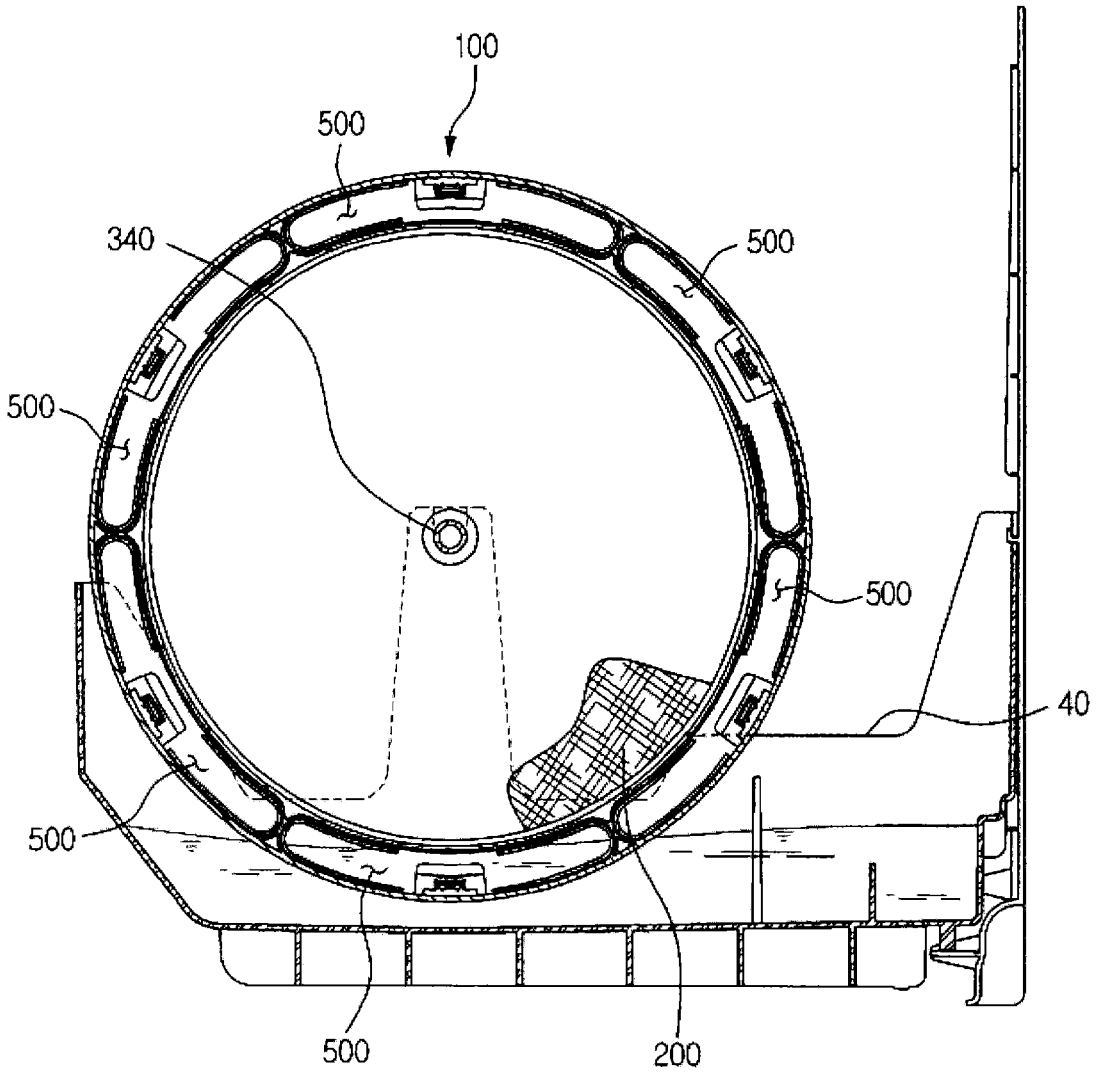
FIG. 6 is a cross-sectional view of the humidifying element assembly of the evaporative humidifier of FIG. 1.
Figure 7:
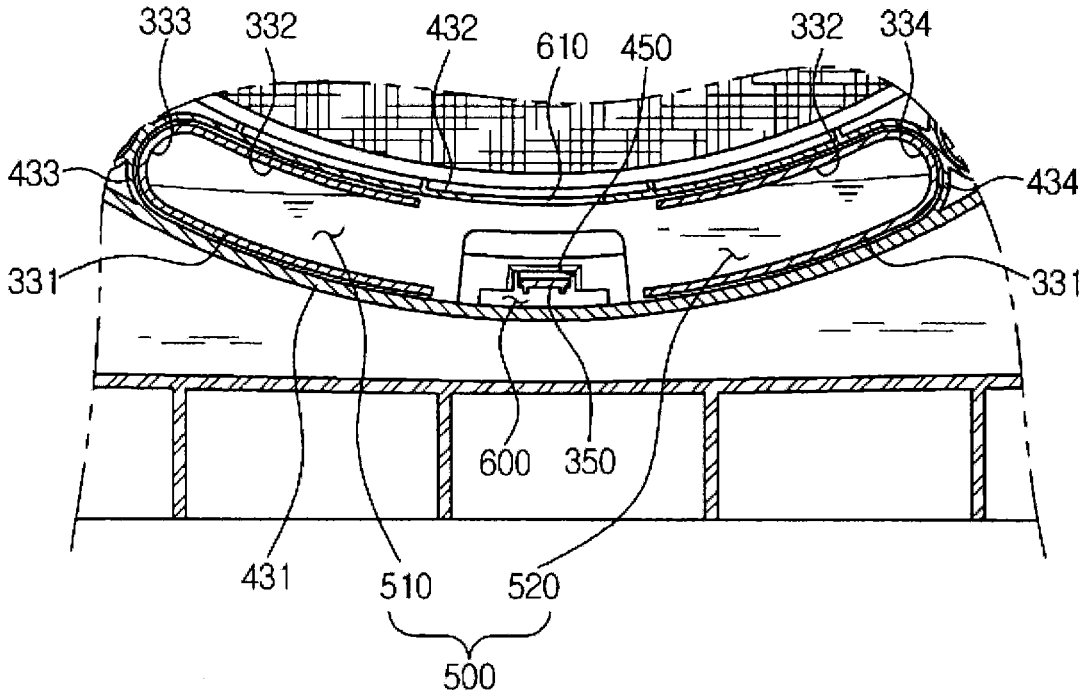
FIG. 7 is an enlarged view of a water pocket of the evaporative humidifier of FIG. 1.
Figure 8:
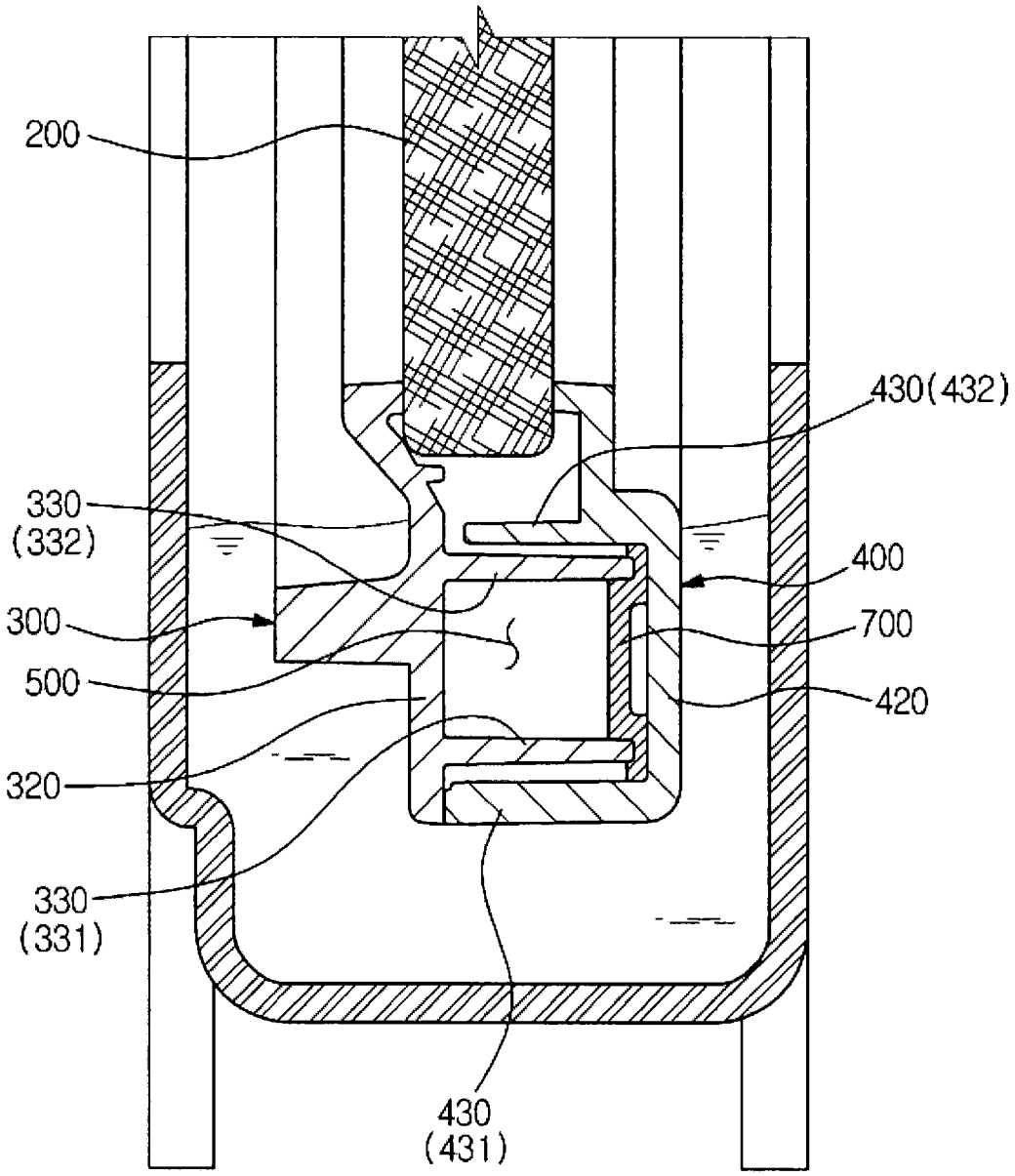
FIG. 8 is a cross-sectional view of the water pocket of the evaporative humidifier of FIG. 1.
Figure 9:
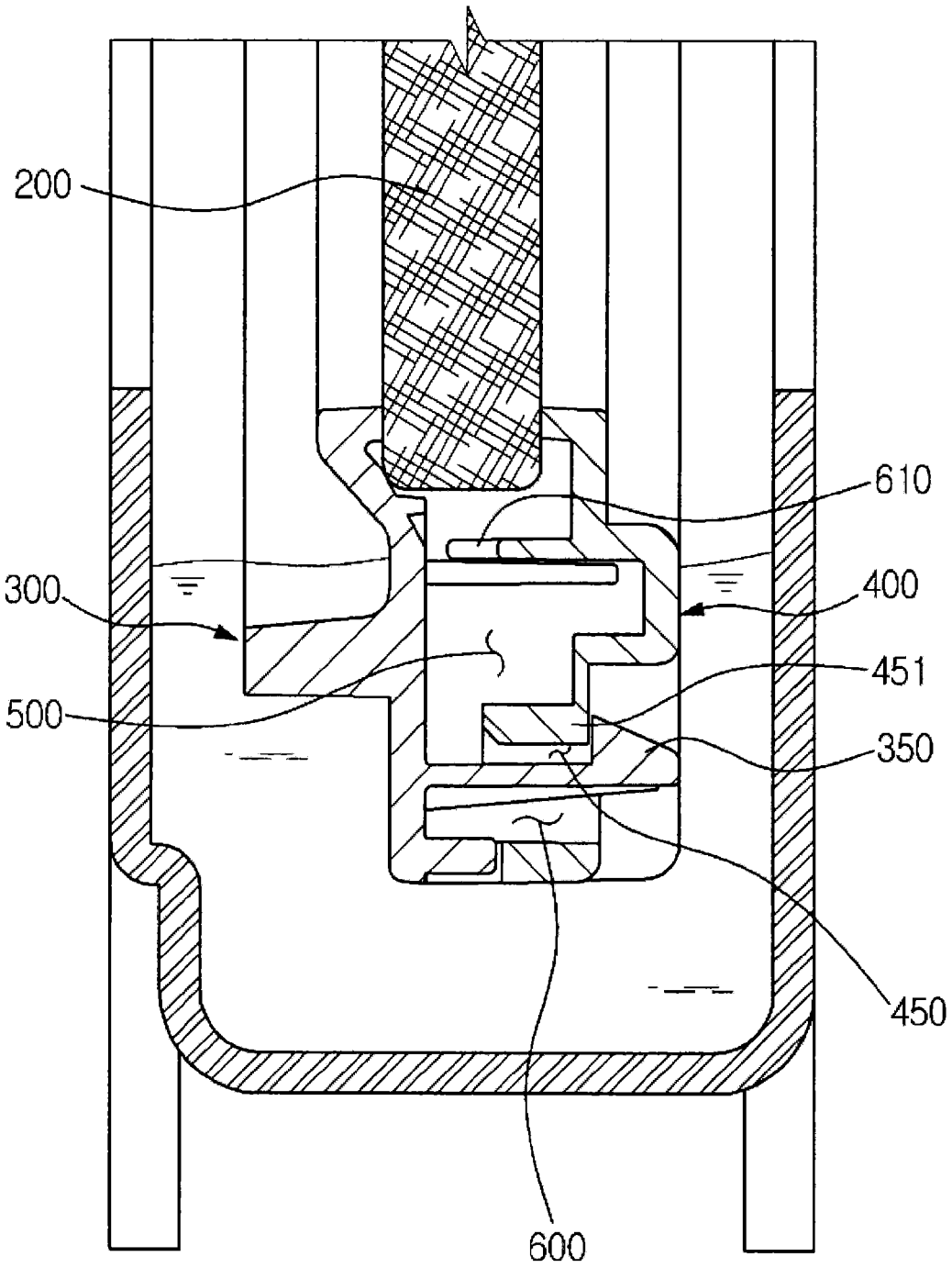
FIG. 9 is a cross-sectional view of another water pocket of the evaporative humidifier of FIG. 1.
Figure 10:
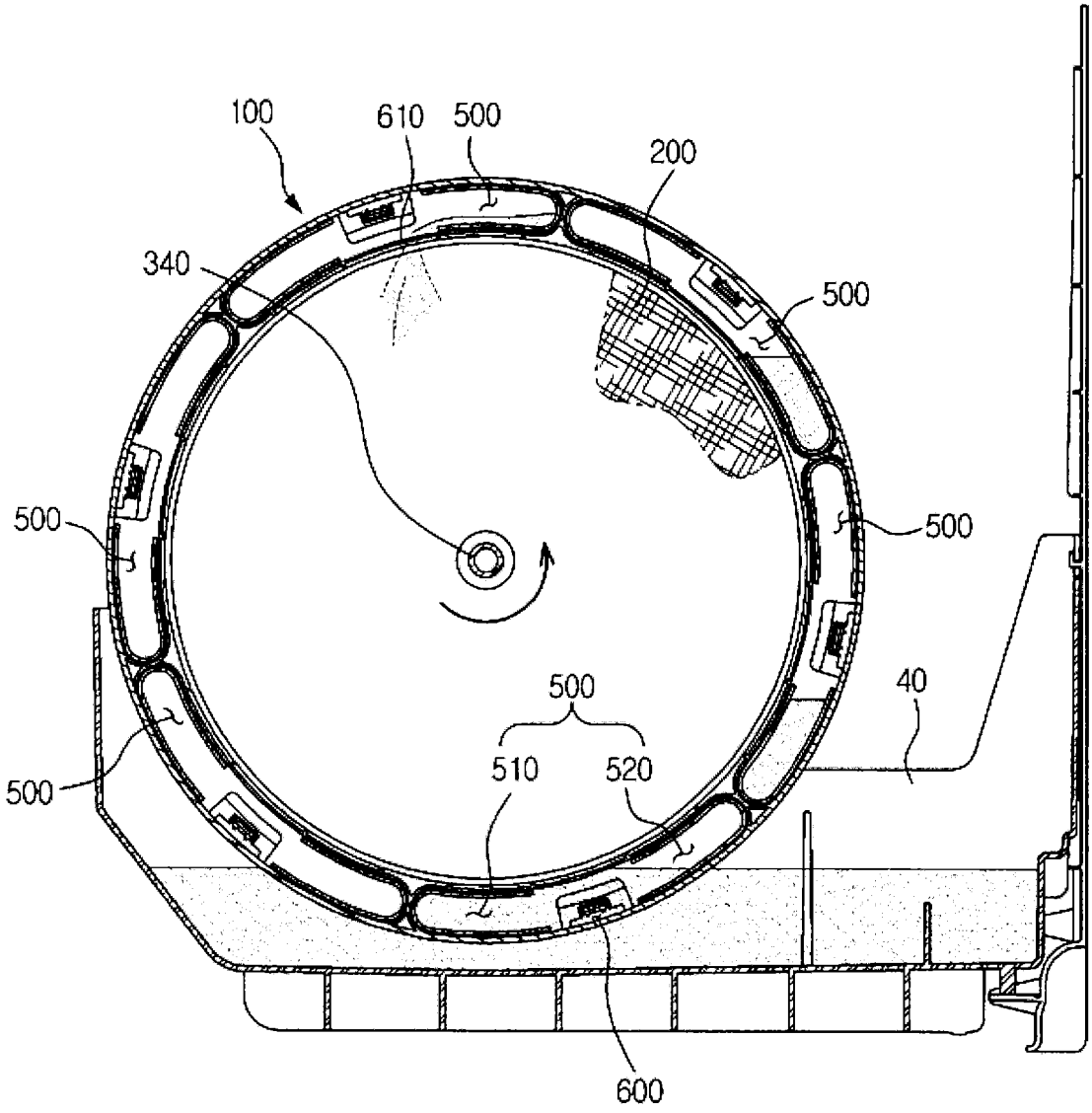
FIG. 10 is a view illustrating the operation of the humidifying element assembly of the evaporative humidifier of FIG. 1.

FIG. 4 is a front exploded perspective view of the humidifying element assembly of the evaporative humidifier of FIG. 1, FIG. 5 is a rear exploded perspective view of the humidifying element assembly of the evaporative humidifier of FIG. 1, FIG. 6 is a cross-sectional view of the humidifying element assembly of the evaporative humidifier of FIG. 1, FIG. 7 is an enlarged view of a water pocket of the evaporative humidifier of FIG. 1, FIG. 8 is a cross-sectional view of the water pocket of the evaporative humidifier of FIG. 1, and FIG. 9 is a cross-sectional view of another water pocket of the evaporative humidifier of FIG. 1.

Hereinafter, with reference to FIGS. 4 to 9, the configuration of the humidifying element assembly 100 of the evaporative humidifier 1 in accordance with the embodiment of the present invention will be described in detail.

The humidifying element assembly 100 includes a humidifying element 200 absorbing water and then evaporating water, and a first cover 300 and a second cover 400 respectively provided in front of and in the rear of the humidifying element 200 so as to support the humidifying element 200.

The humidifying element 200 may be formed of a fabric and have an almost disc shape. The humidifying element 200 receives water from water pockets 500 provided between the first cover 300 and the second cover 400, holds the received water, and then executes humidification of air passing through the humidifying element 200.

Here, impurities, such as dust contained in air, are filtered out by the humidifying element 200, and only pure air may pass through the humidifying element 200. Therefore, the humidifying element 200 may execute a filtering function as well as a humidifying function.

The first cover 300 and the second cover 400 may respectively have a substantially disc-like shape having a greater radius than the radius of the humidifying element 200. The first cover 300 and the second cover 400 may be respectively formed integrally by injection molding using a resin. Although this will be described later, the first cover 300 and the second cover 400 may be easily formed by injection molding through an upper mold and a lower mold separated from each other, and separate complicated molds, such as slide cores, are not required.

Rotary shafts 340 and 440 may be respectively provided on the first cover 300 and the second cover 400, and a through hole 210 through which the rotary shafts 340 and 440 pass may be provided on the humidifying element 200. The rotary shafts 340 and 440 may be rotatably supported by the support frame 50 (with reference to FIG. 3). For example, as shown in FIG. 3, a portion of the frame 50 may extend in an upward vertical direction from a bottom portion of the frame 50 and may include a notch or insertion hole in which one of the rotary shafts 340 and 440 may be inserted into the notch or insertion hole to be rotatably supported. A portion of the frame 50 may extend in an upward vertical direction from a bottom portion of the frame 50 on each side of the humidifying element assembly 100 such that the other rotary shaft 340 or 440 may be inserted into the notch or insertion hole to be rotatably supported.

A teeth part 360 may be provided at an outer edge (e.g., an outer circumferential portion) of the first cover 300, and thus the first cover 300 may receive a rotary force transmitted from the driving motor 70. However, differently from this embodiment, the teeth part 360 may be provided on the second cover 400.

The first cover 300 and the second cover 400 may support the humidifying element 200 and form one or more water pockets 500 supplying water to the upper portion of the humidifying element 200.

For this purpose, the first cover 300 may include a first support unit 310 supporting the humidifying element 200, and a first water pocket formation unit which may be constituted by a first horizontal wall unit 320 and a first vertical wall unit 330 forming a part of each of the water pockets 500.

The first support unit 310 may be formed at the center of the first cover 300 in the radial direction in a size approximately corresponding to the size of the humidifying element 200, and may have a substantially spoke-like shape so that air may pass through the first cover 300.

The first water pocket formation unit may be formed at the circumference of the first support unit 310, and includes the first horizontal wall unit 320 which is generally horizontally extended from the first support unit 310 in the radial direction of the first cover 300 and a first vertical wall unit 330 protruding perpendicularly from the first horizontal wall unit 320 in a rearward direction, that is, in a direction towards the second cover 400 and the humidifying element 200.

In the same manner, the second cover 400 may include a second support unit 410 supporting the humidifying element 200, and a second water pocket formation unit which may be constituted by a second horizontal wall unit 420 and a second vertical wall unit 430 forming the remaining part of each of the water pockets 500.

The second support unit 410 may be formed at the center of the second cover 400 in the radial direction in a size approximately corresponding to the size of the humidifying element 200, and may have a substantially spoke-like shape so that air may pass through the second cover 400.

The second water pocket formation unit may be formed at the circumference of the second support unit 410, and includes the second horizontal wall unit 420 which is generally horizontally extended from the second support unit 410 in the radial direction of the second cover 400 and the first vertical wall unit 430 protruding perpendicularly from the second horizontal wall unit 420 in the rearward direction, that is, in a direction toward the first cover 300 and the humidifying element 200.

The first cover 300 may include elastic hooks 350 protruding toward the second cover 400 to be coupled with the second cover 400, and the second cover 400 may include insertion holes 450 into which the elastic hooks 350 are inserted and support walls 451 supporting the elastic hooks 350 having passed through the insertion holes 450.

The elastic hooks 350, the insertion holes 450 and the support walls 451 may be formed at outer edges (e.g., an outer circumferential portion) of the first cover 300 and the second cover 400.

The elastic hooks 350 may pass through the insertion holes 450 and then be supported by the support walls 451, thereby achieving coupling between the first cover 300 and the second cover 400. In order to separate the first cover 300 and the second cover 400 from each other to wash and/or replace the humidifying element 200, interference between the elastic hooks 350 and the support walls 451 may be released by applying pressure to the elastic hooks 350, and thus the first cover 300 and the second cover 400 may be separated from each other.

However, other coupling structures than the above-described coupling structure may be used as long as the first cover 300 and the second cover 400 may be secured together and separated from each other.

When the first cover 300 and the second cover 400 are coupled, the first water pocket formation unit of the first cover 300 and the second water pocket formation unit of the second cover 400 may form one or more water pockets 500.

The water pockets 500 in accordance with the embodiment of the present invention are extended in the circumferential direction, differently from the conventional bowl-shaped water pocket. Further the water pockets 500 are not protruded outwardly in the circumferential direction of the first cover 300 and the second cover 400, and are formed between the first cover 300 and the second cover 400 at the insides of the outermost edges of the first cover 300 and the second cover 400.

As shown in FIG. 6, the first water pocket formation unit and the second water pocket formation unit may form six water pockets 500. However, the number of the water pockets 500 is not limited thereto. The number of water pockets 500 may be more or less than six water pockets. The water pockets 500 may be immediately adjacent to one another to form a ring about the outer circumferential portion of the first cover 300 and second cover 400. Alternatively, one of ordinary skill in the art could space apart the water pockets 500 from one another by a desired distance.

The tub 40 may be filled or partially filled with water to a predetermined level. When a water pocket 500 is located at a lower portion of the humidifying element assembly 100 the water pocket 500 may be filled with water. Thereafter, the water pocket 500 located at the lower portion of the humidifying element assembly 100 carries the contained water as the water pocket 500 moves upwards, and drops the contained water by gravity when the water pocket 500 reaches an upper portion of the humidifying element assembly 100, thereby supplying water to the upper portion of the humidifying element 200.

Since water supplied to the upper portion of the humidifying element 200 slowly descends along the humidifying element 200, evaporation may be generated throughout most regions of the humidifying element 200.

Now, with reference to FIG. 7, the configurations of the first vertical wall unit 330 of the first cover 300 and the second vertical wall unit 430 of the second cover 400 will be described in more detail.

The first vertical wall unit 330 of the first cover 300 includes an outer wall part 331 formed in the circumferential direction of the first cover 300, an inner wall part 332 formed in the circumferential direction of the first cover 300 and provided at an inner region as compared with the outer wall part 331 so as to be separated from the outer wall part 331 by a designated interval. The first vertical wall unit 330 of the first cover 300 further includes a first side wall part 333 connecting one end of the outer wall part 331 and one end of the inner wall part 332, and a second side wall part 334 connecting the other end of the outer wall 331 and the other end of the inner wall part 332. The first side wall part 333 and second side wall part 334 may be curve shaped, such that the outer wall part 331, inner wall part 332, and first side wall part 333 taken together form a u-shaped portion. Likewise, the outer wall part 331, inner wall part 332, and second side wall part 334 taken together may also form a u-shaped portion.

In the same manner, the second vertical wall unit 430 of the second cover 400 includes an outer wall part 431 formed in the circumferential direction of the second cover 400, an inner wall part 432 formed in the circumferential direction of the second cover 400 and provided at an inner region as compared with the outer wall part 431 so as to be separated from the outer wall part 431 by a designated interval. The second vertical wall unit 430 of the second cover 400 further includes a first side wall part 433 connecting one end of the outer wall part 431 and one end of the inner wall part 432, and a second side wall part 434 connecting the other end of the outer wall 431 and the other end of the inner wall part 432. The first side wall part 433 and second side wall part 434 may be curve shaped, such that the outer wall part 431, inner wall part 432, and first side wall part 433 taken together form a u-shaped portion. Likewise, the outer wall part 431, inner wall part 432, and second side wall part 434 taken together may also form a u-shaped portion.

Therefore, the first vertical wall unit 330 and the second vertical wall unit 430 may be provided so as to overlap with each other. Further, the first vertical wall unit 330 may be located at the inside of the second vertical wall unit 430. However, differently from this embodiment, the second vertical wall unit 430 may be located at the inside of the first vertical wall unit 330.

Therefore, as shown in FIG. 8, the water pocket 500 may be formed by the first vertical wall unit 330, the first horizontal wall unit 320 and the second horizontal wall unit 420. That is, the water pocket 500 may be an inner space formed by the first vertical wall unit 330, the first horizontal wall unit 320 and the second horizontal wall unit 420.

The second vertical wall unit 430 serves to guide the first vertical wall unit 330 when the first cover 300 and the second cover 400 are coupled. Further, maintenance of airtightness of the water pocket 500 may be improved by overlapping the first vertical wall unit 330 and the second vertical wall unit 430 with each other.

As described above, the water pockets 500 of the evaporative humidifier 1 in accordance with the embodiment of the present invention may be formed by the horizontal wall units 320 and 420 and the vertical wall units 330 and 430 which may be formed using only upper and lower cores. Therefore, mold costs may be reduced, as compared to the conventional bowl-shaped water pocket formed using plural slide cores.

As shown in FIG. 7, the humidifying element assembly 100 includes inflow holes 600 through which water in the tub 40 is introduced into the water pockets 500 when the water pockets 500 are located at the lower portion of the humidifying element assembly 100, and outflow holes 610 through which water in the water pockets 500 drops to the upper portion of the humidifying element 200 when the water pockets 500 are located at the upper portion of the humidifying element assembly 100. The inflow holes 600 and outflow holes 610 may disposed opposite from one another in the water pocket, the outflow holes 610 being located relatively closer to the humidifying element 200 than the inflow holes 600.

The inflow holes 600 and the outflow holes 610 are formed separately, and are provided so as to substantially communicate with the centers of the water pockets 500 in the circumferential direction.

As shown in FIG. 7, the inflow holes 600 may be formed on the second cover 400, and be formed at the outsides of the insertion holes 450 into which elastic hooks 350 of the first cover 300 are inserted, in the radial direction. The inflow holes 600 are not limited thereto, and may be formed so as to communicate with the centers of the water pockets 500. Further, the inflow holes 600 are formed at positions which may be submerged in water in the tub 40.

Further, the outflow holes 610 may be formed by cutting corresponding portions of the inner wall part 332 of the first cover 300 and the inner wall part 432 of the second cover 400.

Each water pocket 500 includes plural sub water pockets 510 and 520 provided at both sides of the center of the water pocket 500 opposite each other. That is, the water pocket 500 includes a first sub water pocket 510 formed by a portion of the outer wall part 331, a portion of the inner wall part 332 and the first side wall part 333, and a second sub water pocket 520 formed by the remaining portion of the outer wall part 331, the remaining portion of the inner wall part 332 and the second side wall part 334. Each of the sub water pockets 510 and 520 may be substantially u-shaped.

Therefore, if the first sub water pocket 510 carries water when the humidifying element assembly 100 is rotated in one of the clockwise direction and the counterclockwise directions, the second sub water pocket 510 may carry water when the humidifying element assembly 100 is rotated in the other of the clockwise direction and the counterclockwise directions. Therefore, water may be carried by the water pocket 500 regardless of the rotating direction of the humidifying element assembly 100.

Therefore, when a motor which is freely rotatable in any direction is used as the driving motor 70 (with reference to FIG. 3) which provides rotary force to the humidifying element assembly 100, water supply through the water pockets 500 may be carried out regardless of the rotation direction force provided by the driving motor 70. Thus, even if rotation of the humidifying element assembly 100 in one direction is disturbed for a specific reason and the humidifying element assembly 100 is rotated in the opposite direction, water may be supplied by the water pockets 500.

Further, since the inflow hole 600 through which water is introduced into the water pocket 500 may be formed at the center of the water pocket 500 and the sub water pockets 510 and 520 are formed at both sides of the center of the water pocket 500 so that water introduced through the inflow hole 600 is contained in both sub water pockets 510 and 520, the water pocket 500 of the evaporative humidifier 1 in accordance with the embodiment of the present invention may carry a large amount of water, as compared to the conventional bowl-shaped water pocket. Therefore, the degree of humidification by the evaporative humidifier 1 may be increased.

As shown in FIGS. 4, 5 and 8, the humidifying element assembly 100 may further include a gasket 700 to maintain airtightness of the water pockets 500. The gasket 700 may be formed of rubber and provided between the first cover 300 and the second cover 400.

The gasket 700 may be interposed between the end of the vertical wall unit 330 of the first cover 300 and the horizontal wall unit 420 of the second cover 400. Therefore, the gasket 700 hermetically seals a gap between the end of the vertical wall unit 330 of the first cover 300 and the horizontal wall unit 420 of the second cover 400, thus allowing water contained in the water pockets 500 to be carried to the upper portion of the humidifying element assembly 100 without leakage.

In this embodiment of the present invention, the gasket 700 is not essential, and may be omitted if the vertical wall unit 330 of the first cover 300 and the horizontal wall unit 420 of the second cover 400 are closely adhered to each other.

As is apparent from the above description, in an evaporative humidifier in accordance with one embodiment of the present invention, water pockets drawing water up from a tub and supplying the water to the upper portion of a humidifying element may be formed through molds having a relatively simple structure, and thus manufacturing costs of the evaporative humidifier may be reduced.

Further, the water pockets in accordance with the embodiment of the present invention may draw water up from the tub regardless of the rotating direction of a humidifying element assembly.

Further, each water pocket in accordance with the embodiment of the present invention includes a first sub water pocket and a second sub water pocket formed at both sides of the center of the water pocket, and thus the water carrying capacity of the water pockets may be increased and the degree of humidification by the evaporative humidifier may be increased.

Although a few example embodiments of the present invention have been shown and described, it would be appreciated by those skilled in the art that changes may be made to these embodiments without departing from the principles and spirit of the invention, the scope of which is defined in the claims and their equivalents.

What is claimed is:

1. An evaporative humidifier comprising:

a main body;

an air blower fan provided within the main body to forcibly blow air;

a tub provided within the main body to store water; and a humidifying element assembly rotatably provided within the main body, wherein the humidifying element assembly includes:

a humidifying element to perform humidification;

a first cover provided in front of the humidifying element, and including a first support unit provided at a center of the first cover to support the humidifying element, a first horizontal wall unit provided at an edge of the first cover, and a first vertical wall unit protruding perpendicularly from the first horizontal wall unit in a rearward direction;

a second cover provided in back of the humidifying element, coupled with a rear portion of the first cover, and including a second support unit provided at a center of the second cover to support the humidifying element, a second horizontal wall unit provided at an edge of the second cover, and a second vertical wall unit protruding perpendicularly from the second horizontal wall unit in a forward direction toward the first cover; and at least one water pocket to supply water to an upper portion of the humidifying element by drawing water up from the tub and then dropping the water, formed by the first horizontal wall unit, the first vertical wall unit, the second horizontal wall unit and the second vertical wall unit, wherein the humidifying element assembly further includes an inflow hole through which water is introduced into the at least one water pocket, and an outflow hole through which water in the at least one water pocket drops to the upper portion of the humidifying element, and the inflow hole and the outflow hole are formed at a center of the at least one water pocket.

2. The evaporative humidifier according to claim 1, wherein at least six water pockets are formed by the first horizontal wall unit, the first vertical wall unit, the second horizontal wall unit and the second vertical wall unit.

3. The evaporative humidifier according to claim 1, wherein the first vertical wall unit and the second vertical wall unit overlap with each other.

4. The evaporative humidifier according to claim 1, wherein each of the first vertical wall unit and the second vertical wall unit includes an outer wall part formed in the circumferential direction of the humidifying assembly element, an inner wall part formed in the circumferential direction of the humidifying assembly element and provided at an inner region relative to the outer wall part, a first side wall part connecting one end of the outer wall part and one end of the inner wall part, and a second side wall part connecting the other end of the outer wall and the other end of the inner wall part.

5. The evaporative humidifier according to claim 4, wherein each of the at least one water pocket includes a first sub water pocket formed by a portion of the outer wall part, a portion of the inner wall part and the first side wall part, and a second sub water pocket formed by the remaining portion of the outer wall part, the remaining portion of the inner wall part and the second side wall part.

6. The evaporative humidifier according to claim 5, wherein when the at least one water pocket moves upwards, water is stored in the first sub water pocket when the humidifying element assembly is rotated in one of the clockwise direction and the counterclockwise direction, and water is stored in the second sub water pocket when the humidifying element assembly is rotated in the other of the clockwise direction and the counterclockwise direction.

7. The evaporative humidifier according to claim 1, wherein:

the first cover includes first coupling parts provided at the edge of the first cover to be coupled with the second cover; and the second cover includes second coupling parts provided at the edge of the second cover so as to correspond to the first coupling parts.

8. The evaporative humidifier according to claim 7, wherein one of the first coupling parts and the second coupling parts includes elastic hooks, and the other of the first coupling parts and the second coupling parts includes support walls supporting the elastic hooks.

9. The evaporative humidifier according to claim 1, wherein an outer circumferential portion of the humidifying element is disposed adjacent to an inner wall part of the second vertical wall unit such that when the humidifying element assembly is rotated, no portion of the humidifying element is submerged in water in the tub.

10. The evaporative humidifier according to claim 1, further comprising a driving motor providing a rotary force to rotate the humidifying element assembly, wherein one of the first cover and the second cover includes a teeth part disposed on an outer edge thereof which is engaged with a gear of the driving motor and receiving the rotary force transmitted from the driving motor.

11. The evaporative humidifier according to claim 1, further comprising a gasket provided between the first cover and the second cover to maintain airtightness of the at least one water pocket.

12. The evaporative humidifier according to claim 1, wherein the first cover and the second cover are respectively formed integrally by injection molding.

13. An evaporative humidifier comprising:

a main body;

an air blower fan provided within the main body to forcibly blow air;

a tub provided within the main body to store water; and a humidifying element assembly rotatably provided within the main body, wherein the humidifying element assembly includes:

a humidifying element to perform humidification;

at least one water pocket formed at an outer circumference of the humidifying element to draw water up from the tub and then to supply the water to an upper portion of the humidifying element;

a first cover provided in front of the humidifying element to support the humidifying element; and a second cover provided in back of the humidifying element to support the humidifying element, and coupled with a rear portion of the first cover, wherein an inflow hole is provided at a center of each of the at least one water pocket to allow water to be introduced into each of the at least one water pocket through the inflow hole, and a first sub water pocket and a second sub water pocket are formed at both sides of the inflow hole of each of the at least one water pocket opposite each other.

14. The evaporative humidifier according to claim 13, wherein:

the first cover includes a first water pocket formation unit forming a part of the at least one water pocket, the second cover includes a second water pocket formation unit forming another part of the at least one water pocket, the first water pocket formation unit includes a first horizontal wall unit, and a first vertical wall unit protruding perpendicularly from the first horizontal wall unit toward the second cover, and the second water pocket formation unit includes a second horizontal wall unit, and a second vertical wall unit protruding perpendicularly from the second horizontal wall unit toward the first cover.

15. The evaporative humidifier according to claim 14, wherein:

each of the first vertical wall unit and the second vertical wall unit includes an outer wall part formed in a circumferential direction of the humidifying assembly element, an inner wall part formed in the circumferential direction of the humidifying assembly element and provided at an inner region relative to the outer wall part, a first side wall part connecting one end of the outer wall part and one end of the inner wall part, and a second side wall part connecting the other end of the outer wall and the other end of the inner wall part; and the first sub water pocket is formed by a portion of the outer wall part, a portion of the inner wall part and the first side wall part, and the second sub water is pocket formed by the remaining portion of the outer wall part, the remaining portion of the inner wall part and the second side wall part.

16. An evaporative humidifier comprising:

a main body;

an air blower fan provided within the main body to forcibly blow air;

a tub provided within the main body to store water; and a humidifying element assembly rotatably provided within the main body, wherein the humidifying element assembly includes a humidifying element to perform humidification and at least one water pocket formed at the circumference of the humidifying element to draw water up from the tub and then to supply the water to the upper portion of the humidifying element, wherein each of the at least one water pocket includes an inflow hole provided at a center of each of the at least one water pocket to allow water to be introduced into each of the at least one water pocket through the inflow hole, and an outflow hole provided at the center of each of the at least one water pocket to allow water in each of the at least one water pocket to drop to an upper portion of the humidifying element through the outflow hole.

17. The evaporative humidifier according to claim 16, wherein each of the at least one water pocket includes a first sub water pocket and a second sub water pocket formed at both sides of the center of each of the at least one water pocket opposite each other.

18. An evaporative humidifier comprising:

a main body;

a tub disposed within the main body to store water; and a humidifying element assembly disposed within the main body, rotatable in clockwise and counterclockwise directions, wherein the humidifying element assembly includes:

a humidifying element to perform humidification;

a first cover disposed on a first side of the humidifying element;

a second cover disposed on a second side of the humidifying element and coupled to the first cover; and a plurality of water pockets formed by the coupling of the first cover and the second cover at an outer circumferential region of the first cover and second cover, to transport water from the tub in an upward direction in either the clockwise or counterclockwise directions when the humidifying element assembly is rotated, and to drop water on an upper portion of the humidifying element, wherein an inflow hole is provided at a center of each of the at least one water pocket to allow water to be introduced into each of the at least one water pocket through the inflow hole, and each of the plurality of water pockets includes a first sub water pocket formed at one side of the inflow hole to drop water when the humidifying element assembly is rotated in the clockwise direction, and a second sub water pocket formed at an opposite side of the inflow hole to drop water when the humidifying element assembly is rotated in the counterclockwise direction.

19. The evaporative humidifier according to claim 18, wherein:

the first cover includes a first horizontal wall unit provided at an outer circumferential region of the first cover, and a first vertical wall unit protruding perpendicularly from the first horizontal wall unit in a rearward direction toward the humidifying element, the second cover includes a second horizontal wall unit provided at an outer circumferential region of the second cover, and a second vertical wall unit protruding perpendicularly from the second horizontal wall unit in a forward direction toward the humidifying element, and the first vertical wall unit and second vertical wall unit overlap with one another when the first cover and second cover are coupled together.

20. The evaporative humidifier according to claim 18, wherein the first cover and the second cover have a radius greater than a radius of the humidifying element, such that when the humidifying element assembly is rotated in a clockwise or counterclockwise direction, no portion of the humidifying element is submerged in water in the tub.

21. The evaporative humidifier according to claim 18, wherein each of the plurality of water pockets includes an outflow hole provided at each of the at least one water pocket at a side of the at least one water pocket opposite of the inflow hole, to discharge water in the at least one water pocket to the upper portion of the humidifying element.

* * * * *